US005685579A

United States Patent [19]

Funk et al.

[11] Patent Number: 5,685,579

[45] Date of Patent: Nov. 11, 1997

[54] CHILD-SAFETY CUTOUT FOR MOTOR-VEHICLE DOOR LATCH

[75] Inventors: Bernhard Funk, Essen; Gerhard Menz, Heiligenhaus, both of Germany

[73] Assignee: Kiekert AG, Heiligenhaus, Germany

[21] Appl. No.: 615,701

[22] Filed: Mar. 13, 1996

[30] Foreign Application Priority Data

Mar. 22, 1995 [DE] Germany ..... 195 10 337.8

[51] Int. Cl.[6] ..... E05C 3/06

[52] U.S. Cl. ..... 292/216; 292/336.3; 292/DIG. 65

[58] Field of Search ..... 292/216, 336.3, 292/DIG. 65, DIG. 38

[56] References Cited

U.S. PATENT DOCUMENTS

| | | | |
|---|---|---|---|
| 3,098,671 | 7/1963 | Moss | 292/221 |
| 3,596,482 | 8/1971 | Pollak | 292/216 |
| 4,487,441 | 12/1984 | Miyamoto et al. | 292/336.3 |
| 4,900,074 | 2/1990 | Kleefeldt et al. | 292/DIG. 65 X |
| 4,969,673 | 11/1990 | Portelli et al. | 292/216 |
| 5,092,638 | 3/1992 | Mizuki | 292/DIG. 65 X |
| 5,125,701 | 6/1992 | Hayakawa | 292/336.3 |

FOREIGN PATENT DOCUMENTS

| | | | |
|---|---|---|---|
| 2 043 238 | 8/1974 | Germany | 292/216 |
| 35918 | 3/1979 | Japan | 292/216 |

*Primary Examiner*—Rodney M. Lindsey
*Assistant Examiner*—Monica E. Millner
*Attorney, Agent, or Firm*—Herbert Dubno; Andrew Wilford

[57] ABSTRACT

A motor-vehicle door latch has a housing, a latching fork on the housing pivotable into and out of a locked position, a latching pawl engageable with the fork and pivotable into and out of a retaining position holding the lock in the locked position, and a release lever connected to the latching pawl. A main inside actuating lever pivotal on the housing carries a secondary inside actuating lever provided with an actuating pin and pivotal on the main inside actuating lever between a coupling position with the pin engageable with the release lever on pivoting of the main lever and a decoupling position unengageable with the release lever on pivoting of the main lever. An inside door handle connected to the main inside actuating lever can pivot same and, only in the coupling position of the secondary lever, engage the pin against the release lever and displace the pawl out of the retaining position. An integral child-safety assembly including a knob, a shaft fixed on the knob, and a fork fixed on the shaft and engaging directly around the pin is displaceable between an off position holding the pin in the coupling position and an on position holding the pin in the decoupling position.

7 Claims, 5 Drawing Sheets

CHILD-SAFETY CUTOUT FOR MOTOR-VEHICLE DOOR LATCH

FIELD OF THE INVENTION

The present invention relates to a motor-vehicle door latch. More particularly this invention concerns a child-safety cutout for such a door latch.

BACKGROUND OF THE INVENTION

A standard motor-vehicle door latch has a housing that is mounted on a door edge and in which is mounted a fork that can pivot and engage around a door bolt projecting from a door jamb. A latching pawl also pivotal on the lock housing about an axis parallel to that of the fork can engage a detent on the fork and retain it in the latched position engaged around the door bolt to hold the door closed in the latched position. An inside door handle is connected through an appropriate linkage to an inside-door lever in the latch that can act directly on the latching pawl to move it into a freeing position in which it permits the fork to pivot and release the door bolt.

In addition an outside door handle is normally provided that is connected through a locking mechanism and appropriate linkage to the latching pawl. The locking mechanism, which in turn can normally be operated by a lock cylinder on the outside of the door and a button or lever inside the door, can either disconnect the outside handle from the latch mechanism or block movement of the outside handle to maintain the latch in a locked condition.

U.S. Pat. No. 5,125,701 of Hayakawa proposes a system whereby the inside handle can be disconnected from the latch mechanism, without disconnecting the outside handle. Thus the door can only be opened from outside so that a child playing in the rear seat cannot accidentally open a door and fall out. The mechanism for doing this requires at least one two-stage lever coupling and adds excessively to the complexity and manufacturing costs of the latch, which is a mass-produced volume item.

OBJECTS OF THE INVENTION

It is therefore an object of the present invention to provide an improved.

Another object is the provision of such an improved which overcomes the above-given disadvantages, that is which has a child-safety cutout but that is fairly simple in construction.

SUMMARY OF THE INVENTION

A motor-vehicle door latch has according to the invention a housing, a latching fork on the housing pivotable into and out of a locked position, a latching pawl engageable with the fork and pivotable into and out of a retaining position holding the lock in the locked position, and a release lever connected to the latching pawl. A main inside actuating lever pivotal on the housing carries a secondary inside actuating lever carrying an actuating pin and pivotal on the main inside actuating lever between a coupling position with the pin engageable with the release lever on pivoting of the main lever and a decoupling position unengageable with the release lever on pivoting of the main lever. An inside door handle connected to the main inside actuating lever can pivot same and, only in the coupling position of the secondary lever, engage the pin against the release lever and displace the pawl out of the retaining position. According to the invention an integral child-safety assembly including a knob, a shaft fixed on the knob, and a fork fixed on the shaft and engaging directly around the pin is displaceable between an off position holding the pin in the coupling position and an on position holding the pin in the decoupling position.

The integral assembly, which means that all its parts are rigidly interconnected so as to move jointly, is therefore a very simple element that serves to effectively couple and decouple the pin from the release lever. During manufacture of the latch the parts are assembled together, normally with the knob on an outside face of the housing, the shaft extending through a plate of the housing, and the fork inside the housing. The knob can be directly actuatable, or formed with a slot so that a tool like a screwdriver or key is needed to rotate the child-safety assembly.

According to a feature of the invention the pin can be carried on the child-safety assembly and the fork on the secondary lever. Otherwise the system will work identically.

According to a feature of the invention a spring is engaged between the main and secondary levers and urges the secondary lever into the decoupling position. Furthermore the secondary lever, and the child-safety assembly are all pivotal about substantially parallel respective axes. The latching fork, latching pawl, and release lever are all pivotal about substantially parallel axes generally perpendicular to the axes of the main lever, secondary lever, and child-safety assembly. The release lever has a bent-over end engageable with the pin.

To prevent the fork from getting disengaged from the pin if the latch is actuated when in the child-safety on position the fork has a short arm engaging the pin on displacement from the coupling to the decoupling position and a long arm engaging the pin on displacement from the decoupling to the coupling position.

The secondary lever has an effective length measured between its pivot axis and the pin that is equal to at least twice an effective length of the fork measured between its pivot axis and the pin. In this manner it is possible to use a relative small angular displacement—30° to 45°—of the child-safety assembly to move it between its positions.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
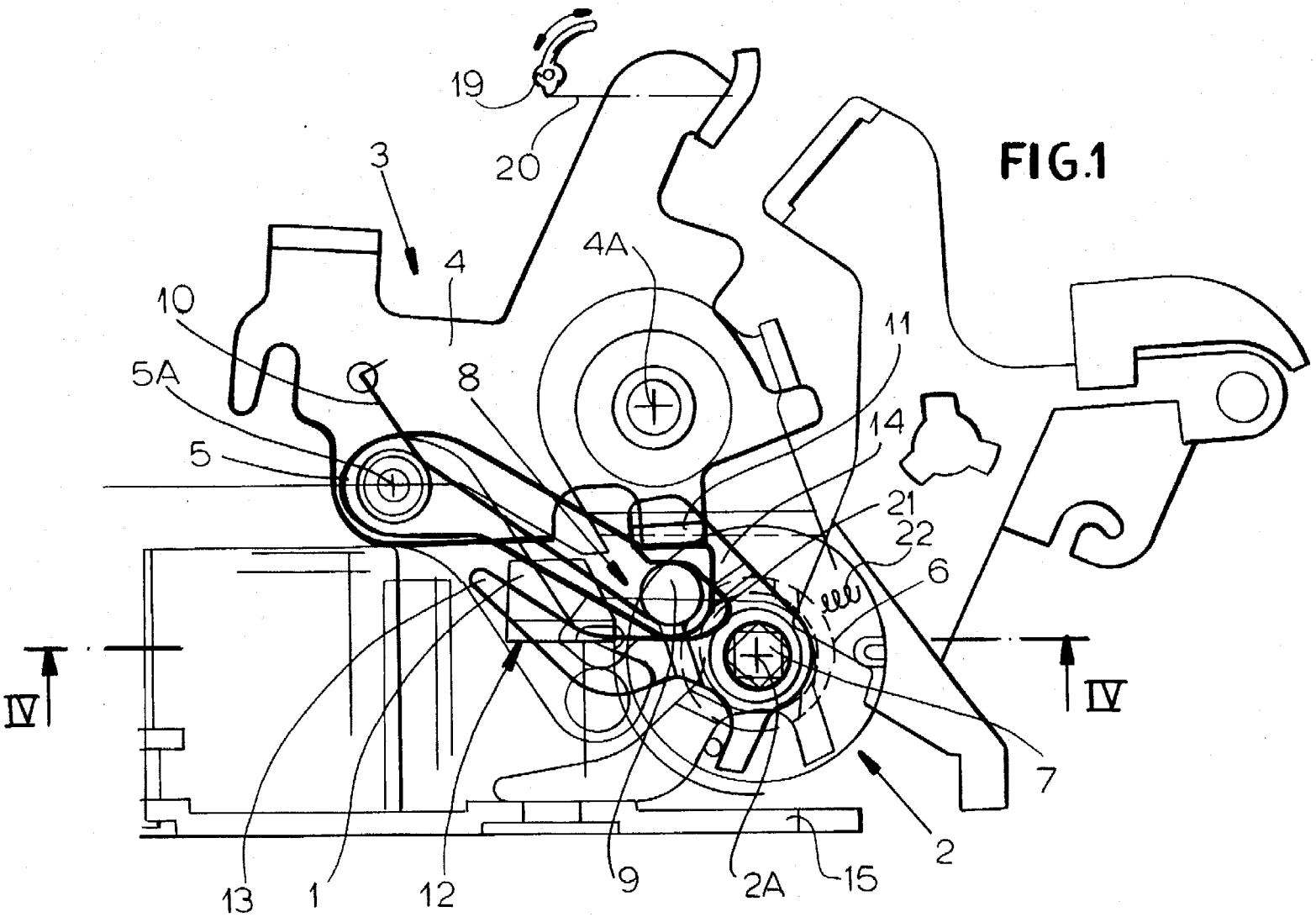
FIG. 1 is a partly diagrammatic and sectional top view of a latch according to the invention in the child-safety off position.
Figure 4:
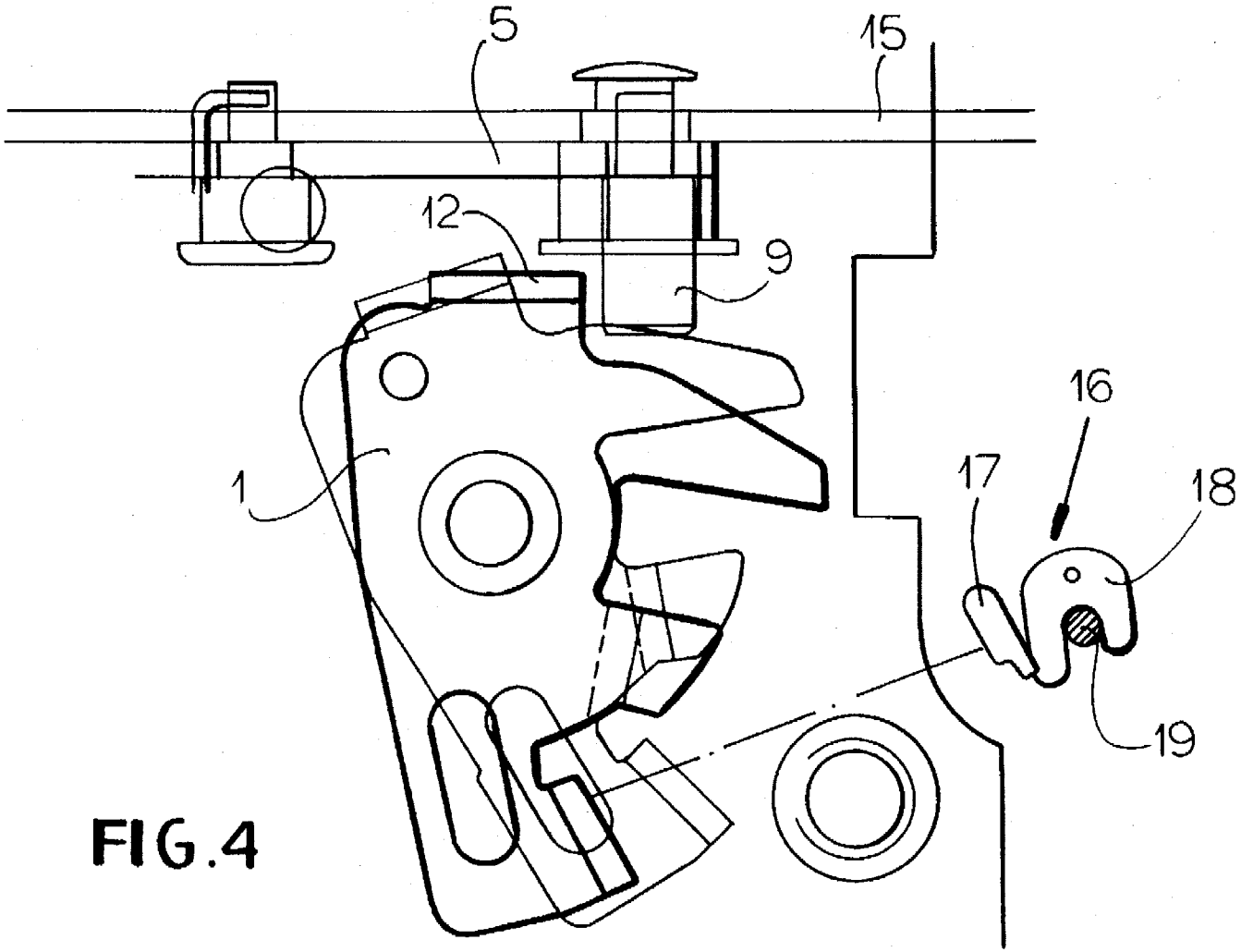
FIG. 4 is a sectional and diagrammatic view taken along line II—II of FIG. 1.
Figure 5:
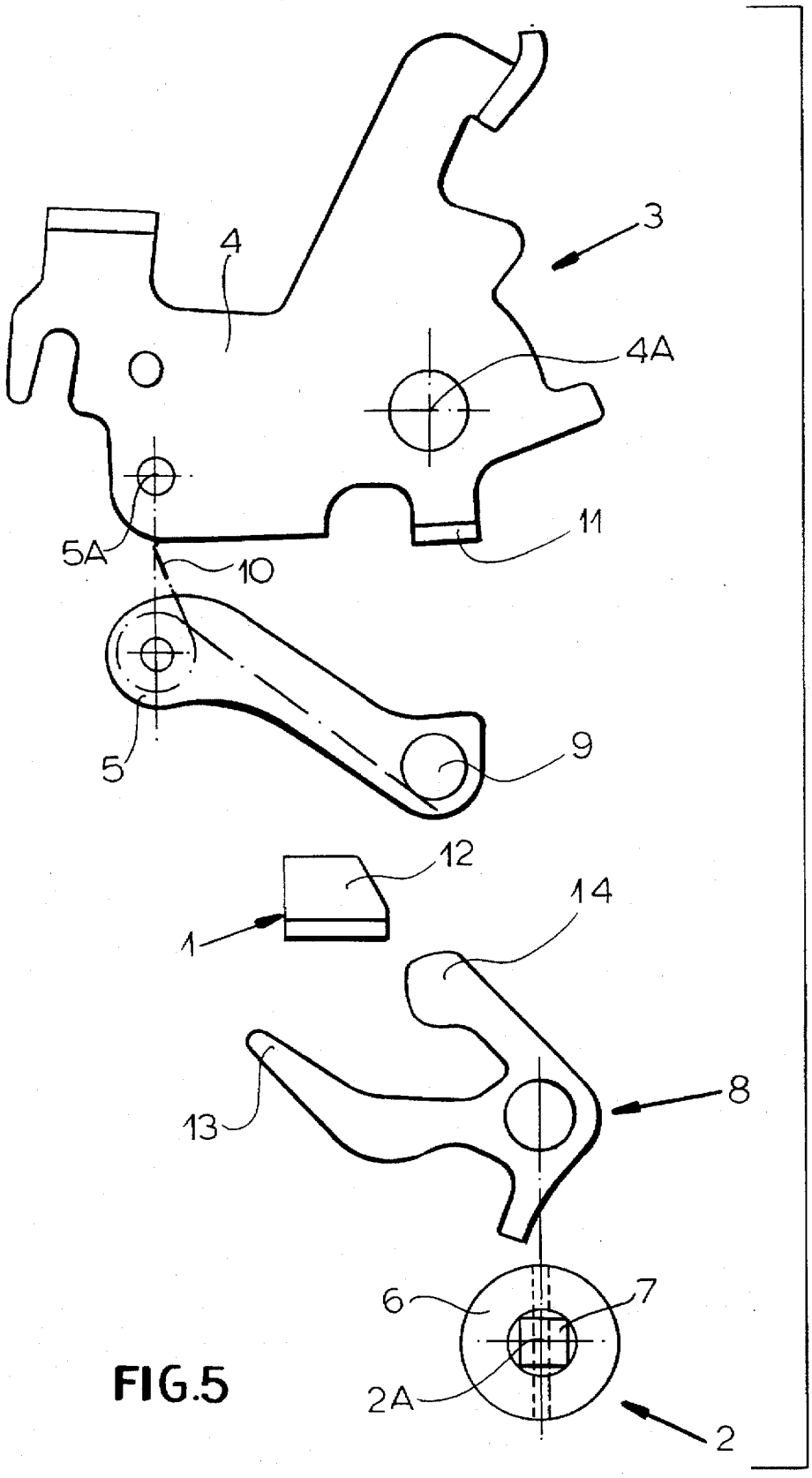
FIG. 5 is an exploded view of the main elements of the latch.

As seen in FIGS. 1, 4 and 5 a motor-vehicle door latch according to the invention has a housing 15 normally mounted on an edge of a door and cooperating with a door bolt 19 mounted on an adjacent door jamb. The latch has a release lever 1 that can act on a latching pawl 17 engageable with a latching fork 18 of a latch mechanism shown at 16 in FIG. 4 but actually mounted right on the housing 15 and incorporated in the latch. The fork 18, pawl 17, and lever 1 are all rotatable about parallel axes.

The latch has an inside actuating assembly 3 and a child-safety cutout assembly 2. The inside-actuating assembly 3 comprises a main actuating lever 4 operated by an inside door handle 19 via a schematically illustrated linkage 20 and a secondary actuating lever 5. The lever 4 is pivoted on the housing 15 about an axis 4A and the lever 5 is pivoted on the lever 4 about an axis 5A parallel to the axis 4A and a spring 10 urges the lever 5 into a child-safety off position as described below. An outer end of the secondary lever 5 carries a pin 9 extending parallel to the axes 4A and 5A and engageable with a bent-over tab 12 formed on the end of the lever 1 that is pivotal about an axis 1A perpendicular to the axes 4A and 5A and normally parallel to pivot axes of the pawl 17 and fork 18.

The child-safety assembly 2 is actually formed as a single integral, that is rigidly interconnected, piece, and comprises an actuating knob 6, a guide shaft 7, and a switching fork 8. The knob 6 is accessible at the door edge when the door is open for setting the assembly 2. The fork 8 has a long arm 13 and a short arm 14 forming a gap 21 receiving the pin 9 and a detent spring illustrated schematically at 22 releasably retains the fork 8 in the off and on positions respectively shown in FIGS. 1 and 2. The effective length of the lever or arm 5 measured from the axis 5A to the center of the pin 9 is at least twice, preferably three times, as great as the effective length of the fork 8 from the axis 2A to the center of the pin 9.

Figure 3:
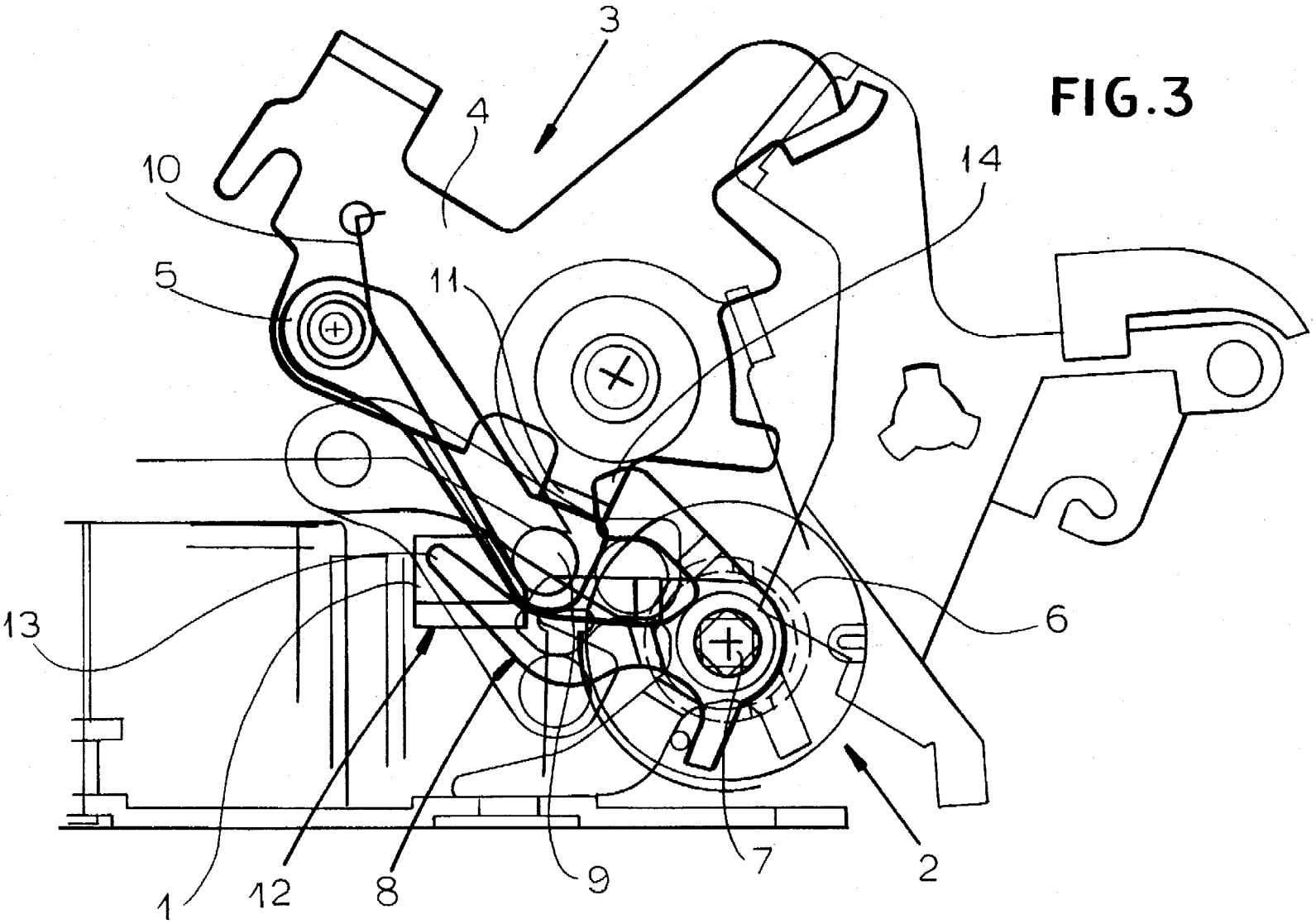
FIG. 3 is a view like FIG. 1 but with the inside door handle actuated.

In the child-safety off position of FIG. 1 the fork 8 holds the pin 9 in a coupling position such that as shown in FIG. 3 clockwise pivoting of the lever assembly 3 about the axis 4A will pull the pin 9 back to engage the bent-over end 12 of the lever 1 and unlatch the door by tripping the pawl 17.

Figure 2:
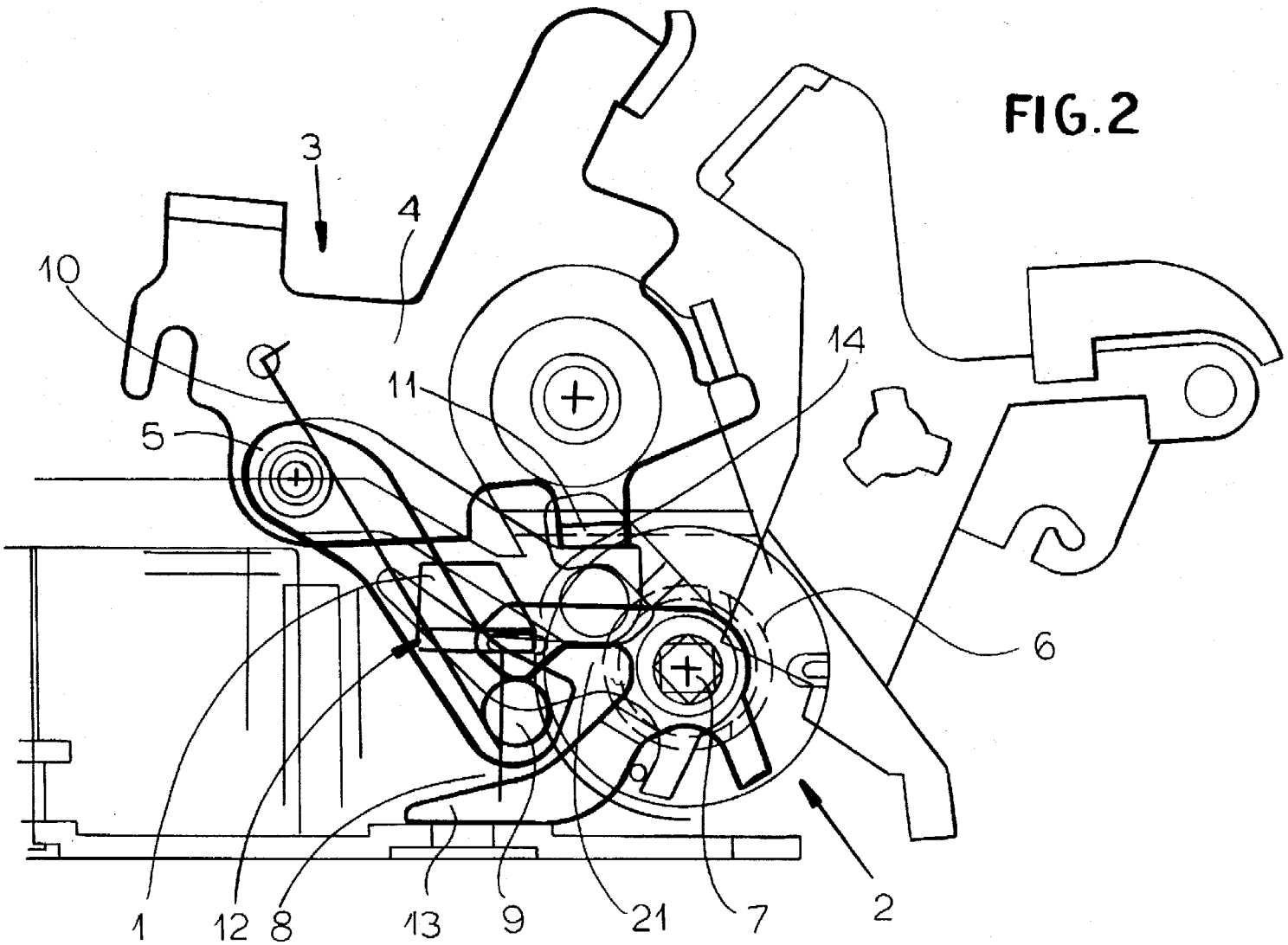
FIG. 2 is a view like FIG. 1 but in the child-safety on position.

In the child-safety on position as shown in FIG. 2 the fork 8 pushes the pin 9 to the side into a decoupling position, thereby pivoting the lever 5 about its axis 5A. If the lever assembly 3 is actuated in this position the pin 9 will move ineffectively past the lever 1 without contacting it. Thus the inside handle 19 will be rendered ineffective but an unillustrated outside handle coupled through an unillustrated locking mechanism with the pawl 17 will be able to open the door.

We claim:

1. A motor-vehicle door latch comprising:

a housing;

a latching fork on the housing pivotable into and out of a locked position;

a latching pawl engageable with the fork and pivotable into and out of a retaining position holding the latch in the locked position;

a release lever connected to the latching pawl;

a main inside actuating lever pivotal on the housing;

a secondary inside actuating lever carrying an actuating pin and pivotal on the main inside actuating lever between a coupling position with the pin engageable with the release lever on pivoting of the main lever and a decoupling position unengageable with the release lever on pivoting of the main lever;

means including an inside door handle connected to the main inside actuating lever for pivoting same and, only in the coupling position of the secondary lever, engaging the pin against the release lever and displacing the pawl out of the retaining position; and an integral child-safety assembly including a knob, a shaft fixed on the knob, and a fork fixed on the shaft and engaging directly around the pin, the assembly being displaceable between an off position holding the pin in the coupling position and an on position holding the pin in the decoupling position.

2. The motor-vehicle door latch defined in claim 1, further comprising a spring engaged between the main and secondary levers and urging the secondary lever into the decoupling position.

3. The motor-vehicle door latch defined in claim 1 wherein the main lever, the secondary lever, and the child-safety assembly are all pivotal about substantially parallel respective axes.

4. The motor-vehicle door latch defined in claim 3 wherein the latching fork, latching pawl, and release lever are all pivotal about substantially parallel axes generally perpendicular to the axes of the main lever, secondary lever, and child-safety assembly.

5. The motor-vehicle door latch defined in claim 4 wherein the release lever has a bent-over end engageable with the pin.

6. The motor-vehicle door latch defined in claim 1 wherein the fork has a short arm engaging the pin on displacement from the coupling to the decoupling position and a long arm engaging the pin on displacement from the decoupling to the coupling position.

7. The motor-vehicle door latch defined in claim 1 wherein the secondary lever has an effective length measured between its pivot axis and the pin that is equal to at least twice an effective length of the fork measured between its pivot axis and the pin.

* * * * *